US008597167B2

(12) United States Patent
Haeger et al.

(10) Patent No.: US 8,597,167 B2
(45) Date of Patent: Dec. 3, 2013

(54) DEVICE AND METHOD FOR PRODUCING BAGS

(75) Inventors: Christian Haeger, Emsbueren (DE); Carsten Tausch, Osnabrueck (DE); Uwe Koehn, Osnabrueck (DE)

(73) Assignee: Windmoeller & Hoelscher KG, Lengerich (DE)

( * ) Notice: Subject to any disclaimer, the term of this patent is extended or adjusted under 35 U.S.C. 154(b) by 298 days.

(21) Appl. No.: 12/736,395

(22) PCT Filed: Mar. 30, 2009

(86) PCT No.: PCT/EP2009/053740

§ 371 (c)(1),
(2), (4) Date: Nov. 1, 2010

(87) PCT Pub. No.: WO2009/121836

PCT Pub. Date: Oct. 8, 2009

(65) Prior Publication Data

US 2011/0053747 A1 Mar. 3, 2011

(30) Foreign Application Priority Data

Apr. 3, 2008 (DE) ..... 10 2008 017 446

(51) Int. Cl.
*B31B 39/00* (2006.01)

(52) U.S. Cl.
USPC ..... 493/218; 493/308

(58) Field of Classification Search
USPC ..... 53/458, 567; 493/308, 309, 310, 218, 493/219
See application file for complete search history.

(56) References Cited

U.S. PATENT DOCUMENTS

| | | | | | |
|---|---|---|---|---|---|
| 333,523 | A | * | 1/1886 | Honiss | 383/121 |
| 3,043,199 | A | * | 7/1962 | Niemeyer | 493/213 |
| 3,272,093 | A | * | 9/1966 | Brockmuller | 493/218 |
| 3,913,463 | A | * | 10/1975 | Hollis | 493/256 |
| 3,924,521 | A | * | 12/1975 | Hanson et al. | 493/209 |
| 4,637,062 | A | * | 1/1987 | Poppe | 383/54 |
| 5,102,383 | A | * | 4/1992 | Achelpohl | 493/226 |
| 5,549,538 | A | * | 8/1996 | Marsik | 493/218 |
| 5,989,172 | A | * | 11/1999 | Achelpohl | 493/189 |
| 6,042,526 | A | * | 3/2000 | Baumer | 493/218 |
| 6,328,683 | B1 | * | 12/2001 | Rautenberg | 493/255 |
| 6,740,020 | B2 | * | 5/2004 | Horibe et al. | 493/218 |
| 2003/0104913 | A1 | * | 6/2003 | Schwenke et al. | 493/150 |
| 2003/0104914 | A1 | * | 6/2003 | Schwenke et al. | 493/150 |

FOREIGN PATENT DOCUMENTS

| | | | |
|---|---|---|---|
| DE | 10 2006 006220 | A1 | 8/2007 |
| EP | 1 253 005 | A | 10/2002 |
| WO | WO 2007/090653 | A1 | 8/2007 |

* cited by examiner

*Primary Examiner* — Hemant M Desai
(74) *Attorney, Agent, or Firm* — Jacobson Holman PLLC

(57) ABSTRACT

An apparatus for producing bags made of tube pieces having fabric made of stretched plastic strips and with two material webs lying on top of each other includes a transport device, via which the tube pieces are conveyed in a horizontal position in a transport direction (x) extending transversely to the direction of extension (z) of the tube pieces, a bottom-opening station, via which open bottom squares are produced on at least one end of a tube piece, a closing station, via which the bottoms opened at the bottom-opening station are folded up, and a bottom-patch station, via which a bottom patch is applied for closing the bag bottom. At least one processing station on the operating side (BS) is disposed such that it is at least partly offset to a similar processing station on the drive side (AS).

12 Claims, 7 Drawing Sheets

DEVICE AND METHOD FOR PRODUCING BAGS

CROSS-REFERENCE TO RELATED APPLICATIONS

The present patent application is a nationalization of International application No. PCT/EP2009/053740, filed Mar. 30, 2009, published in German, which is based on, and claims priority from, German Application No. 102008017446.7, filed Apr. 3, 2008, both of which are incorporated herein by reference in their entireties.

BACKGROUND OF THE INVENTION

1. Field of Invention

The invention relates to an apparatus and a method for producing bags comprising fabric made of stretched plastic strips as described herein.

2. Description of the Prior Art

Such apparatuses are known in the prior art and available on the market for quite a while now. These apparatuses usually first comprise a separating device in order to separate a supplied fabric tube that can additionally be laminated into tube pieces. These tube pieces comprise two material webs lying on top of each other. The tube pieces are then received by at least one transport device in order to deliver them to the individual processing stations. The individual processing stations are listed below together with an explanation of their functions.

- In the pre-creasing station, form punches are lowered onto the tube piece for producing fold lines. The turned-in corners of the opened tube bottom will later be located on these fold lines. The form punches can also be heated for this purpose.
- In the bottom-opening station, at least one end of a tube piece is raised so that a bottom can be molded on this raised end. The turned-in corners will later be located on the fold lines of the tube piece. Due to its geometric shape, the bottom opening is also called bottom square. It should be noted here that the shape of the bottom opening is not square, but rectangular in most cases. Both ends of a tube piece are usually processed in a similar manner.
- In the valve patch station, a valve patch is applied to the previously opened bottom of the tube piece. The valve patch enables the finished bag to be filled later by means of a suitable fill nozzle.
- In a so-called closing station, parts of the bottom openings or the bottom squares, the so-called tabs, are folded back on both sides toward the folded edge and the overlapping portions of these tabs are joined together.
- A bottom patch is then attached, for example heat-sealed, to the folded bottom opening in the bottom patch station.

The individual processing steps of the aforementioned processing stations are usually carried out on both ends of the tube piece. These processing stations are constructed identically on the operating and drive sides of the processing stations in the bag-making machines existing in reality.

It should be mentioned here that all the stations listed above need not be present in an apparatus for producing bags. It is thus possible to dispense with a pre-creasing station. It is also not required to always apply bottom patches in order to produce a bag. Nonetheless, the apparatus may also comprise additional processing stations.

A process of producing bags by the use of machines known in the prior art is explained in brief below. Since the machines known in the prior art are constructed almost identically on the operating and drive sides in order to enable the simultaneous processing of both ends of the tube piece, the different machine sides will not be explained in detail in the following description. A previously separated tube piece is guided along its longitudinal axis with the help of a suitable transport device (for example, a double belt conveyor) to a pre-creasing station. Here, a form punch is lowered onto the tube pieces in a direction extending at right angles to the transport direction of the tube pieces to form folded edges. The turned-in corners of the opened bag bottom, which is shaped in the subsequent bottom-opening station, will later be located on the resulting folded edges. A valve is later fitted to the open bottom in the valve patch station. This valve enables the bag to be filled later by means of a suitable filling device. In the subsequent closing station, the bottom opening of the bag is folded up so that the bag is then finished in the bottom patch station by heat-sealing the bottom opening of the bag to a bottom patch.

The disadvantage of the identical construction of the mutually opposing processing stations known in the prior art is that the tools of the processing stations obstruct each other in the case of small bag formats.

A further disadvantage of this construction of the mutually opposing processing stations consists in the maintenance of the same. When processing stations are located opposite to each other, the often large installation space thereof impedes their accessibility for maintenance purposes. Since a plurality of movable parts is located in the processing stations, it is sometimes necessary to also reset or readjust the same. As a result of the laterally reversed construction of the mutually opposing individual processing stations of the machine, the processing stations are accessible only with difficulty for purposes of altering settings and adjustments.

SUMMARY OF THE INVENTION

It is therefore an object of the present invention to suggest an apparatus for producing bags comprising fabric made of stretched plastic strips, which apparatus facilitates accessibility of the processing stations for maintenance purposes, for example.

According to the invention, this object is achieved by the features described herein.

Thus at least one processing station on the operating side is disposed such that it is at least partly offset to a similar processing station disposed on the drive side. In this context, the term "similar" is understood to mean that the processing stations carry out the same processing steps on the tube piece or have the same function. These machines of the invention are not constructed in a laterally reversed manner on the operating and drive sides.

It is particularly advantageous if the processing stations on the operating side (BS) and the similar processing stations on the drive side (AS) are disposed such that they are completely offset to each other. The term "completely offset" is understood to mean that the operating ranges of the processing stations do not overlap each other in the transport direction of the tube piece. This zipper-like construction of the processing stations enables the operation of the individual tools of the processing stations without any obstruction. Furthermore, this construction increases the accessibility of the individual processing stations and simplifies maintenance thereof.

In a particularly preferred embodiment of the invention, first all the processing stations are disposed one after the other on the operating side (BS), and the similar processing stations are disposed in a completely offset manner relative thereto on the drive side (AS). In this construction, first one end of the bag is finished completely before the other end is processed by the processing stations on the opposite side.

In this case, it is advantageous if at least a first transport device, by means of which the tube pieces can be conveyed in the transport direction, is provided on the operating side, and a second transport device is provided on the drive side such that the second transport device does not overlap the first transport device or overlaps the same only partly. Advantageously, the transport device is a double belt conveyor comprising magnets, for example. The alternating conveyance of the tube pieces or bags on opposite sides of the machine is necessary if the bottom center distance of the bag ends is too small for the similar processing stations to be able to process the bag simultaneously. The bottom center distance is defined by the distance between the folded edges formed in the bottom-opening process. Furthermore, in the case of these extremely small bag formats, the conveyor belts would overlap each other if they were to extend on both sides over the entire extent of the machine in the x direction. The first transport device conveys the tube piece along the processing stations of the first side (operating or drive side). The bag is then received by the second transport device and guided along the processing stations of the second (other) machine side.

It is also advantageous that a transport device is provided for transporting tube pieces "centrally" between the operating side and drive side.

Further exemplary embodiments of the invention are explained below in the present description and the claims.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
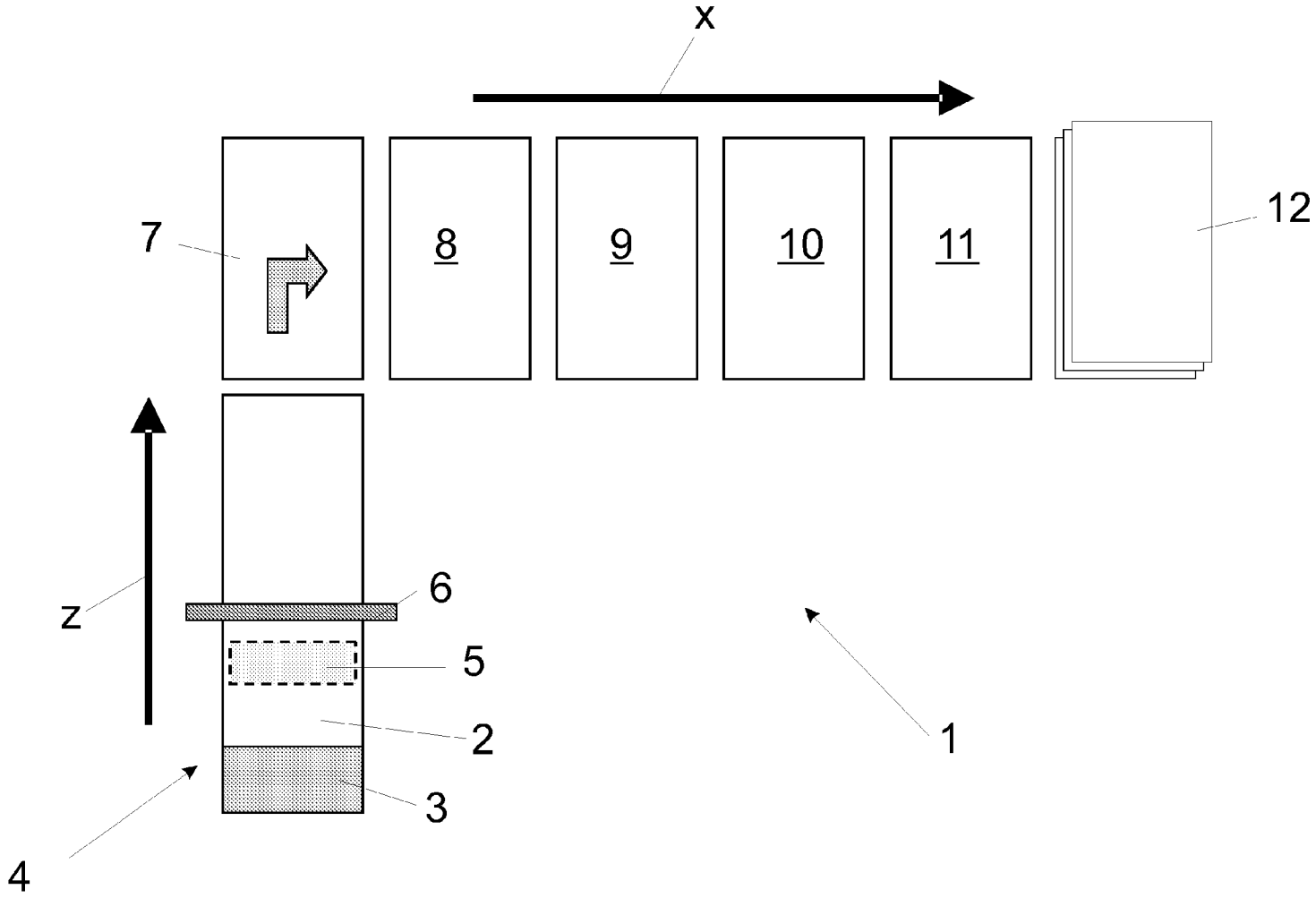
FIG. 1 is a schematic diagram of an apparatus for producing fabric bags

FIG. 1 schematically shows the individual steps for processing a fabric tube to form bags as carried out in the bag-making apparatus 1.

First, the fabric tube 2 is supplied to the bag-making apparatus 1. This is advantageously carried out by unwinding the fabric tube, which forms a spool 3, in an unwinding device 4. Then the tube 2 is provided with a so-called opening in the opening station 5. For this purpose, the fabric tube is guided around an internal tool that separates the two layers from each other so that the layers are isolated from each other if they have been glued together in any of the production steps of the tube. Only in case of separate layers can it be ensured that the subsequent production steps are carried out properly. The material layers of the tube that are separated from each other are then again placed on top of each other.

The fabric tube is now supplied to the cross-cutter 6 that isolates the fabric tube into individual tube pieces.

Then the original transport direction z, in which the tube or tube pieces are transported in the direction of their longitudinal axes, is altered to the new transport direction x so that the tube pieces are no longer transported in the direction z of their longitudinal axes, but instead transversely thereto so that the ends of the tube pieces can be reached laterally for purposes of molding the bottoms.

In the subsequent station, the bottom-opening station 8, both ends of every tube piece are opened and the so-called bottom squares are formed. In the subsequent valve station 9, a valve is fitted and attached to one of the two open ends. The open bottoms are now closed in the bottom-closing station 10, two tabs being placed on top of each other and joined together permanently, for example, by means of a heat-sealing process. The application of a bottom patch to the bottom of each bag in the bottom patch station 11 marks the conclusion of the actual bag-making process. Furthermore, the bottom patches can likewise be welded onto the bottoms of the bags. The finished bags are then placed on the stack 12 and removed from here in a manner not described in detail.

Figure 2:
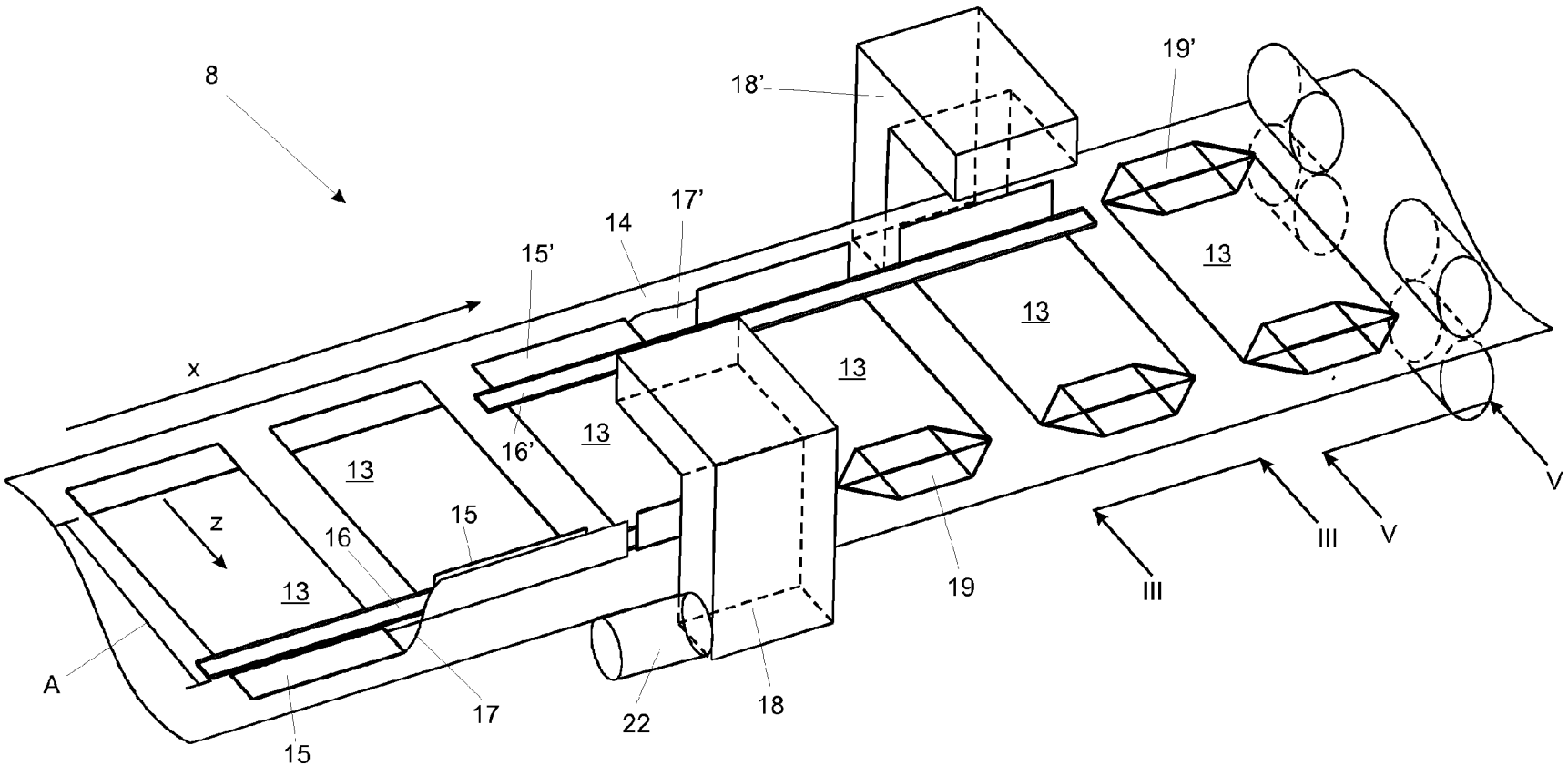
FIG. 2 is a perspective view of a bottom-opening station in an apparatus of the invention.

FIG. 2 shows details of an opening station 5 in an apparatus of the invention. The tube pieces 13 are transported by means of a transport device (not shown in detail) in the direction x such that the tube pieces are located in a flat position, thus horizontally, on the surface of a support 14, for example, on the surface of a table. In order to open an end 15 of the tube piece as suggested by the invention, this end is first brought from its horizontal position into a vertical position. In order to provide the end of the tube piece with fold lines, the tube piece must be subjected to a counter-pressure. For this purpose, the tube piece 13 is arranged below a folding strip 16. This folding strip can be stationary relative to the tube pieces and is thus in motion relative to the support. However, the tube pieces can also be moved relative to the folding strip 16. This is the case, for example, when the folding strip is stationary. The folding strip can be made of a flexible, but greatly prestressed material. The folding strip is preferably made of steel sheets that are joined to the support 14 or the machine frame in a manner not shown. The advantage of steel sheets over other components is that they have smaller thickness and the same load capacity. Once the tube piece 13 is arranged below the folding strip, it is then guided past a guiding element 17 such as a guiding plate.

After the end 15 of the tube piece 13 has been brought into the vertical position, it travels to the actual bottom-opening device 18, which is illustrated only schematically in this figure. In this bottom-opening device 18, two suction bars are provided that engage both sides of the raised end and that are guided in or against the direction z so that the material layers are separated from each other. The internal space of the end 15 of the tube piece 13 is now accessible. Expanding elements that push the material layers further apart now engage in this internal space until the material layers are again located horizontally. This situation is illustrated with the help of the open bottom 19.

The second end 15' of the tube piece 13 is opened similarly, but in an offset manner relative to the opening process of the first end 15. The first end is opened in the bottom-opening device 18 while the second end 15' is still being guided below the folding strip 16'. The opened bottom 19' is produced by means of the guiding element 17' and the bottom-opening device 18' in the manner described above. An offset arrangement of the components of the apparatus of the invention is advantageous when bags having very small bottom center distances A are to be produced.

When leaving the bottom-opening station 8, the tube piece has open bottoms 19, 19', all components of the open bottoms lying essentially in the plane of the support 14.

A special aspect of the bottom-opening station 8 consists in that each bottom-opening device 18, 18' is supplied with torque by means of a separate drive. This is illustrated by the motor 22 at the bottom-opening device 18. The corresponding motor at the bottom-opening device 18' is not visible in the view illustrated. The motor of a bottom-opening device 18, 18' primarily supplies the suction bars with a driving torque so that they can move the material layers away from each other. This motor also supplies the expanding elements with torque.

The draw rolls 23, 23' that serve the purpose of pressing the newly opened bottoms and thus locking them into position form the terminal end of the bottom-opening devices 18, 18'. The bending edges formed in the course of the bottom-opening process are smoothed out and they then form proper folded edges so that the tendency of the bottoms to straighten up again is reduced. Either the support 14 or the backing rolls 24, 24' serve as counter-pressure elements relative to the draw rolls 23, 23'. The draw rolls 23, 23'are disposed at the same height in FIG. 2, when viewed in the transport direction x. These rolls 23, 23'can also be disposed in an offset manner relative to each other so that the open bottoms can also be pressed directly after the opening process in the manner described.

Figure 3:
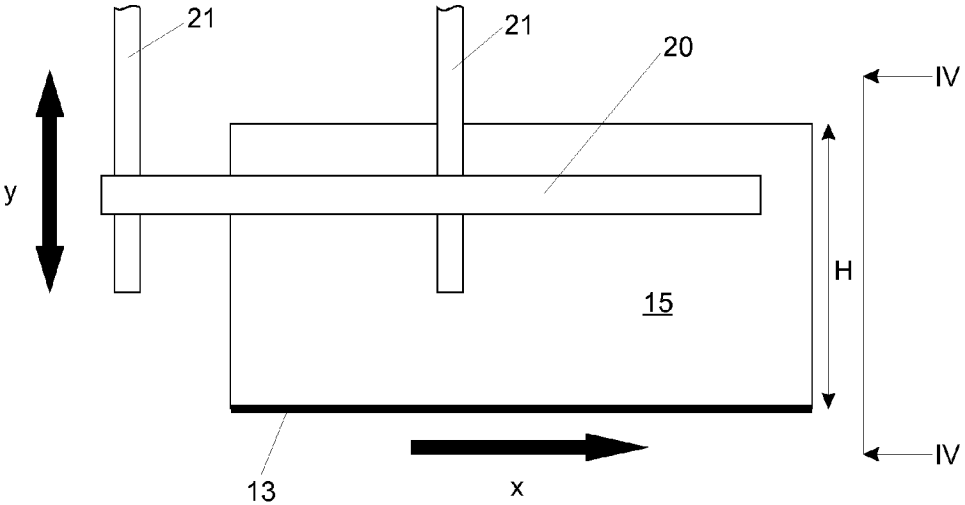
FIG. 3 is a view of section III-III marked in FIG. 2

FIG. 3 shows the view of section III-III marked in FIG. 2. Details of the bottom-opening station 8 are apparent from this FIG. 3. Suction bars, of which the suction bar 20 oriented toward the observer can be seen in the figure, are provided for collecting the material layers of the end 15 of the tube piece 13.

Suction devices that can collect that end 15 of the tube piece 13 that is oriented toward the observer are disposed on that side of the suction bar 20 that is oriented away from the observer.

Since bags having varying bottom widths can be produced by the use of the apparatus 1 of the invention, it is possible that the raised ends 15 of the tube pieces 13 have varying heights H. In order to achieve a proper opening process of the ends by means of the suction devices, the latter should act as closely as possible on the upper edge of the end 15. For this purpose, the suction bars 20, 20' are mounted detachably on vertical guidances 21, 21' so that the suction bars can be moved in the direction of the double arrow y along the raised edges 15 and can be adjusted corresponding to their heights H. The guidances can be formed in various ways. They can be round or rectangular profiles that are solid or hollow.

Figure 4:
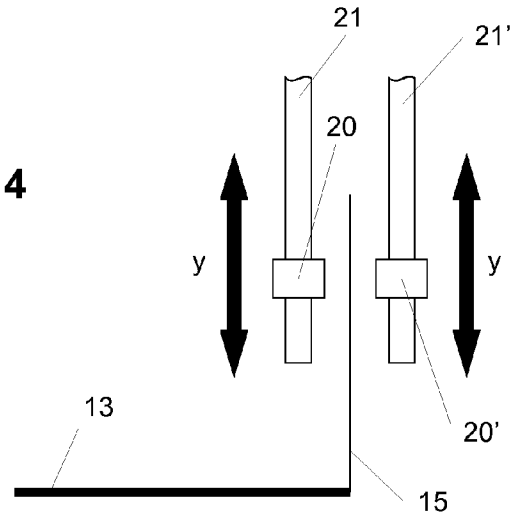
FIG. 4 is a view of section IV-IV marked in FIG. 3

FIG. 4 shows section IV-IV marked in FIG. 3. In addition to the front suction bar 20 and the front guidance 21, suction bar 20' and the guidance 21' are also visible.

Figure 5:
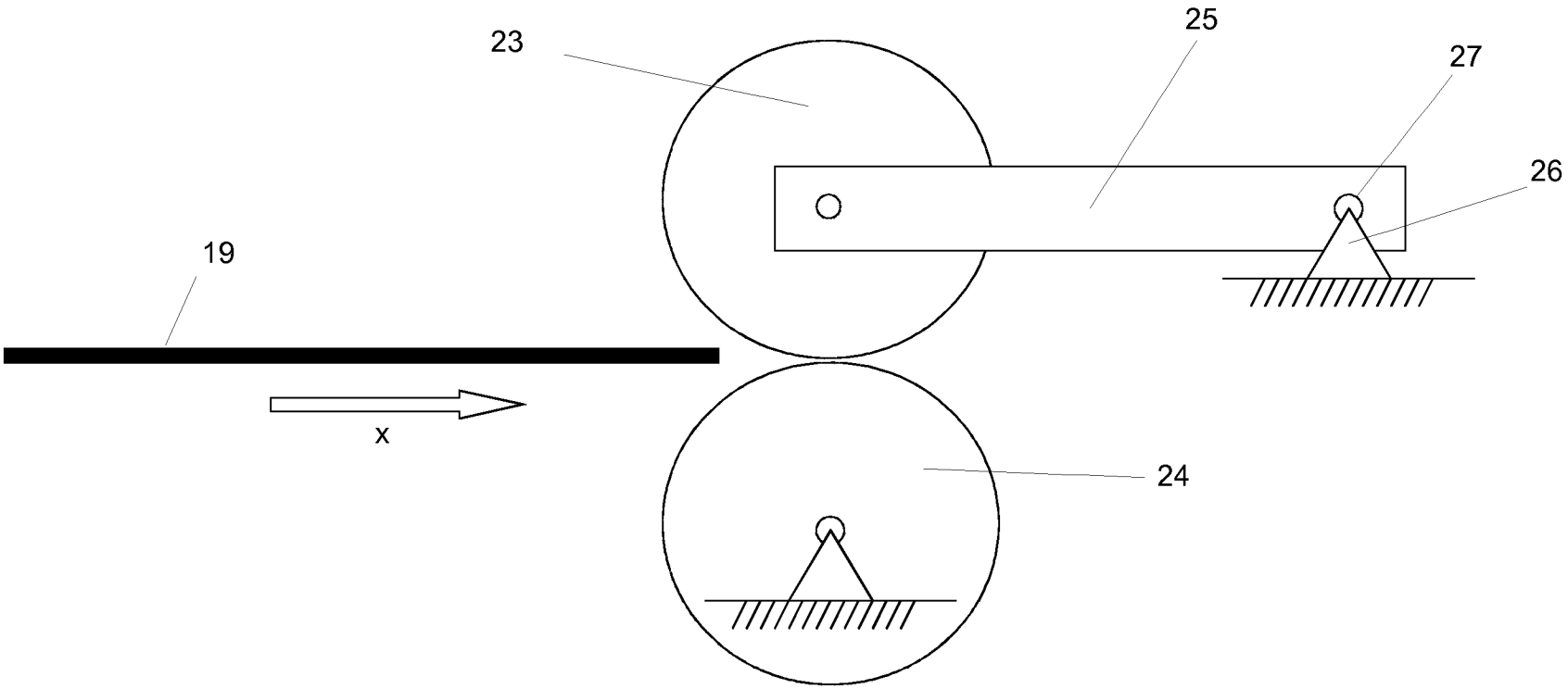
FIG. 5 is a view of section V-V marked in FIG. 2

FIG. 5 shows section V-V marked in FIG. 2. The draw roll 23 is mounted on a lever arm 25 or on a pair of lever arms. The lever arm 25 itself is mounted in the machine frame or in add-on parts 26 of the machine frame so as to be pivotable. In an embodiment, the lever arm 25 is pivotable about an axis 27 that is permanently connected to add-on parts and is fixable on this axis. A suitable clamping device (not shown) can be provided for this purpose. By fixing the lever arm 25 on the axis 27, it is possible to permanently adjust the distance of the circumferential surface of the draw roll 23 from the backing roll or from the support 14. In this way, a contact force is applied to the open bottom only when the application of this force is also required in order to bring the components of the open bottom into the horizontal plane.

In a further embodiment, provision can be made for mounting the lever arm on the axis 27 so as to be freely rotatable. Alternatively, provision can be made for this purpose for permanently connecting the lever arm 25 to a shaft mounted for rotation in the add-on parts. In the aforementioned embodiment, the draw roll 23 can now act on the open bottoms with a predefined force, for example, its own weight.

The support 14 shown in FIG. 2 can serve as the counter-surface for the draw roll in order to press the open bottom. A further option, however, is to provide a backing roll 24 together with which the draw roll 23 forms a gap in which the opens bottoms 19 can be pressed. The backing roll can be disposed such that it can be rotated, but it is stationary relative to the frame.

Figure 6:
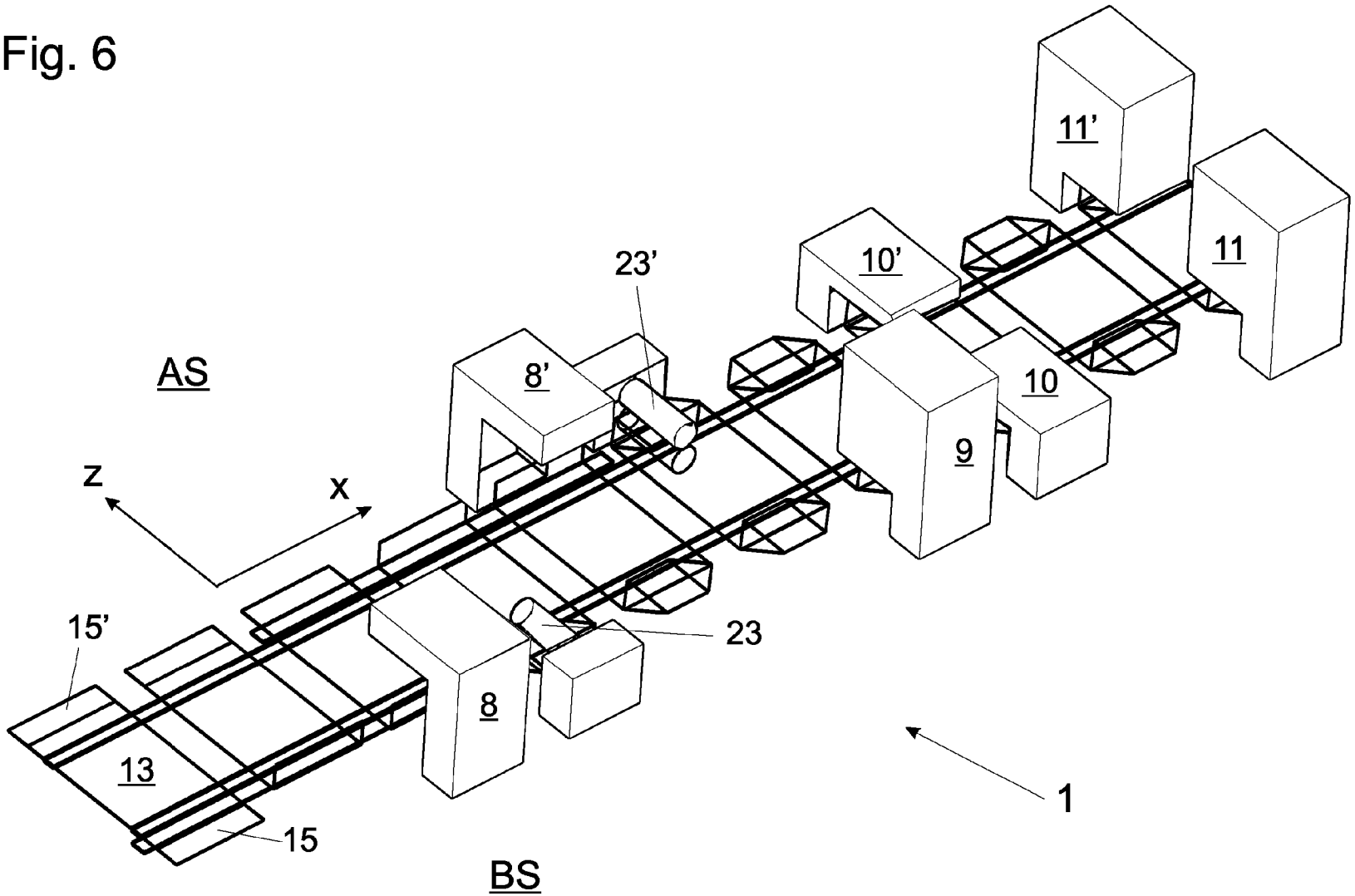
FIG. 6 shows an embodiment of a bag-making machine of the invention

FIG. 6 shows an embodiment of a bag-making machine of the invention. The individual processing stations are shown only schematically here. The tube piece 13 is first guided in the x direction transversely to its longitudinal axis, which extends in the z direction, along a bottom-opening station 8 on the operating side BS. The associated draw roll 23 smoothes out the recently formed bag opening. As the tube piece is transported further in the x direction, a bottom opening 19' is formed on its second end 15' by a bottom-opening station 8' disposed on the drive side AS. The latter 8' is disposed such that it is offset to the bottom-opening station 8 on the operating side in the x direction. The associated draw roll 23' likewise smooths out the newly opened bottom 19'. This offset arrangement of the bottom-opening stations 8, 8' on the operating and drive sides prevents problems of restricted installation space in these processing stations.

The tube piece is then guided to a valve patch station 9 that applies a valve to the bottom opening 19 by means of which filling material can subsequently be introduced into the bag with the help of a suitable filling device.

Notwithstanding FIG. 6, the valve patch station 9 disposed here only on one side, preferably the operating side, can also be located opposite to any of the bottom-opening stations 8, 8'. In the preferred exemplary embodiment, the valve patch station 9 is thus located opposite to the bottom-opening station 8' or the valve patch station 9 at least partly overlaps the bottom-opening station 8'. This configuration enables the production of bags having very small bottom center distances. Furthermore, the apparatus gets by with the smallest possible installation length.

In the bottom closing stations 10, 10', the bottom openings 19, 19' are then folded up before patches are heat-sealed to the bottom openings 19, 19' or glued thereto using a suitable adhesive (extrudate, cold adhesive, etc.) in the bottom-patch stations 11, 11'. The two closing stations 10, 10' are disposed opposite to each other in the present exemplary embodiment. The same applies to the two bottom-patch stations 11, 11'.

Figure 7:
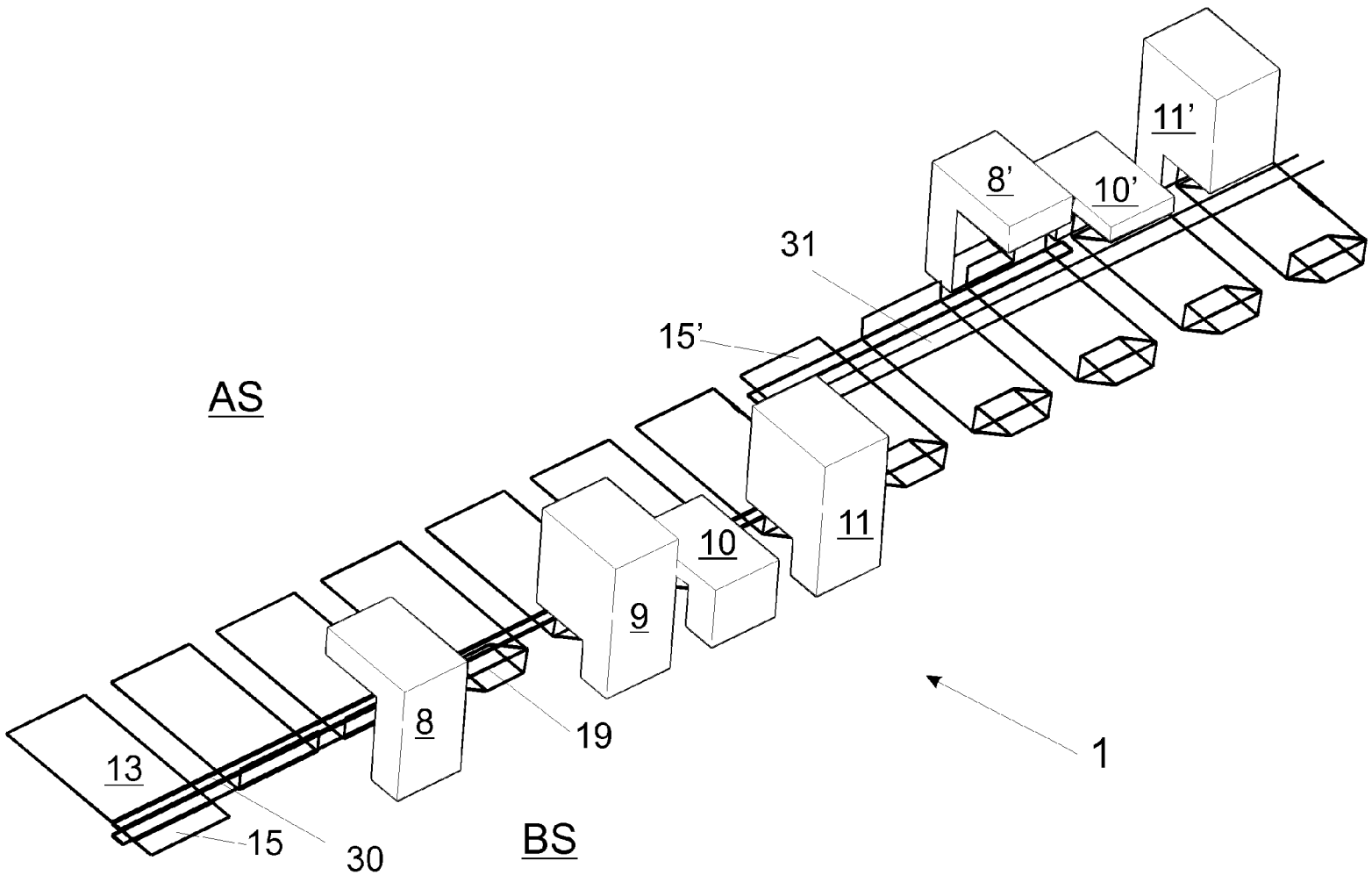
FIG. 7 shows a further embodiment of a bag-making machine of the invention

FIG. 7 shows a further embodiment of the bag-making machine 1 of the invention. The tube pieces 13 are first guided in the x direction transversely to their longitudinal axis with the help of a first transport device 30 to the processing stations 8, 9, 10, 11 successively, which first transport device 30 is located on the operating side BS of the machine 1. A closed bag bottom comprising a valve is formed on the tube piece 13 at the end 15 thereof. Thereafter, the semi-finished bag is delivered to a second transport device 31 located on the drive side AS of the machine 1. With the help of the processing stations 8', 10', 11', the other end 15' of the tube piece 13 or the semi-finished bag is molded into a finished bag bottom. This embodiment enables the production of very small bag formats. In the case of these small bag formats, the conveyor belts of the transport devices 30 and 31 would overlap each other if they were to extend on both sides over the entire extent of the machine in the x direction.

An apparatus according to the embodiment shown in FIG. 7 can also be used flexibly for extremely small bag formats. Due to the offset construction of the processing stations, it is possible to move the operating and drive sides of the machine toward each other so that very small bag formats can be produced.

Figure 8:
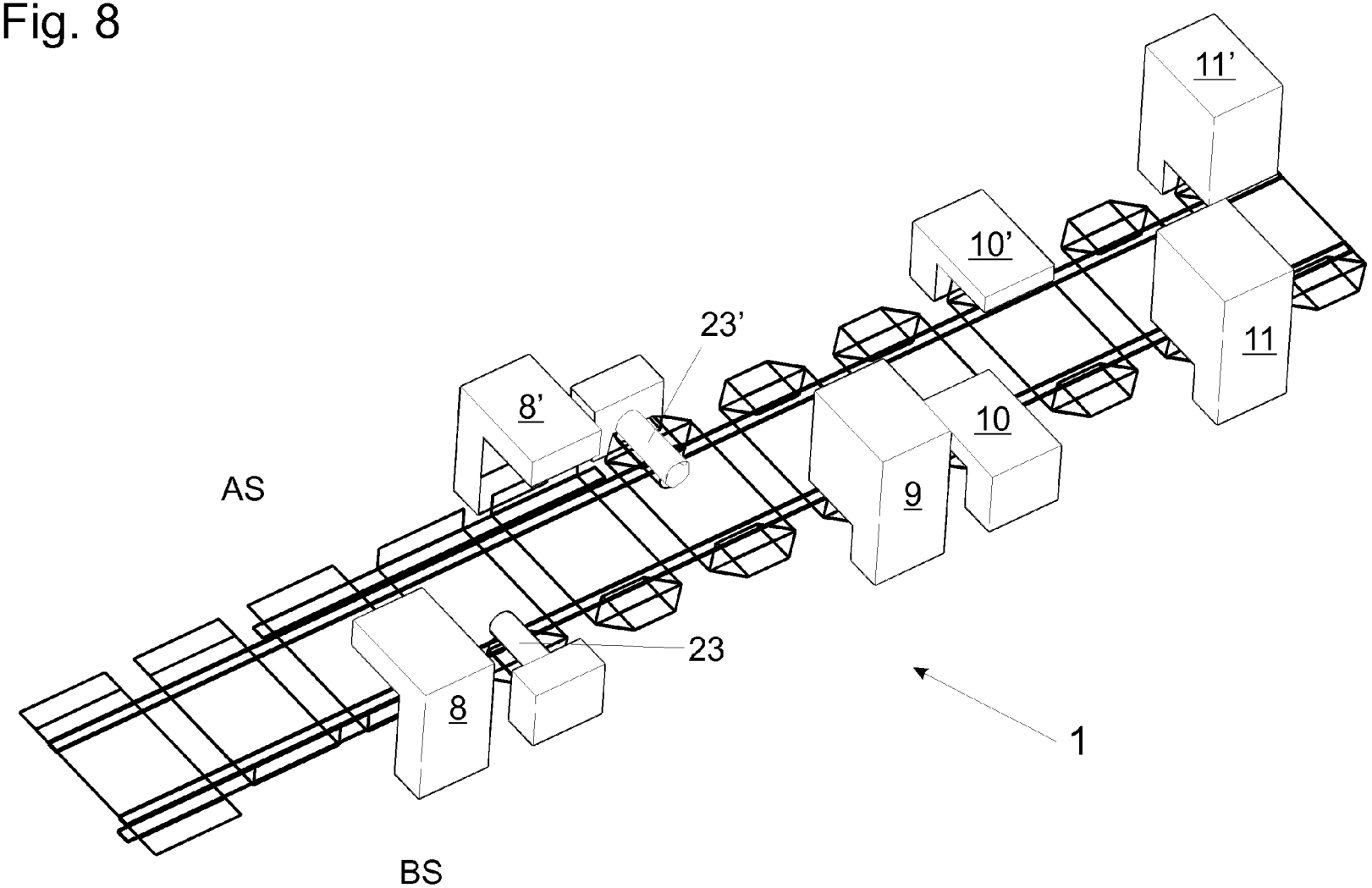
FIG. 8 shows a further embodiment of a bag-making machine of the invention

FIG. 8 shows a further embodiment of the apparatus 1 of the invention for the production of bags. The similar processing stations 8, 8', 10, 10', 11, 11' are disposed in an alternating and offset manner relative to each other on the operating and drive sides. This zipper-like arrangement of the processing stations 8, 8', 10, 10', 11, 11' is interrupted only by the valve station 9 disposed between the bottom-opening station and the closing station 10 on the operating side BS. In this machine layout, all the processing steps for bag production are carried out on the tube piece 13 alternately first on the operating side BS and then on the drive side AS. This arrangement makes all the processing stations easily accessible for maintenance purposes.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

List of reference numerals

| | |
|---|---|
| 1 | Bag-making apparatus |
| 2 | Fabric tube |
| 3 | Spool |
| 4 | Unwinding device |
| 5 | Layer-separating station |
| 6 | Cross-cutter |
| 7 | Device for altering the transport direction |
| 8, 8' | Bottom-opening station |
| 9 | Valve patch station |
| 10, 10' | Bottom-closing station, closing station |
| 11, 11' | Bottom patch station |
| 12 | Bag stack |
| 13 | Tube piece |
| 14 | Support |
| 15, 15' | End of the tube piece |
| 16, 16' | Folding strip |
| 17, 17' | Guiding element |
| 18, 18' | Bottom-opening device |
| 19, 19' | Open bottom |
| 20, 20' | Suction bar |
| 21, 21' | Vertical guidance |
| 22 | Motor |
| 23, 23' | Draw roll |
| 24 | Backing roll |
| 25 | Lever arm |
| 26 | Add-on part |
| 27 | Axis |
| 28 | |
| 29 | |
| 30 | First transport device |
| 31 | Second transport device |
| A | Bottom center distance |
| H | Height of the end 15 |
| x | Transport direction of the tube pieces 13 |
| y | Direction extending orthogonally to the plane defined by the transport direction x and the direction of extension z |
| z | Direction of extension of the tube pieces 13 |
| AS | Drive side |
| BS | Operating side |

What is claimed is:

1. An apparatus for producing bags made of tube pieces having fabric made of stretched plastic strips and two material webs lying on top of each other, said apparatus comprising:

a transport device, via which the tube pieces can be conveyed in a horizontal position in a transport direction (x) extending transversely to a direction of extension (z) of the tube pieces;

a bottom-opening stations, via which open bottom squares can be produced on at least one end of a tube piece;

a closing station, via which bottoms opened at the bottom-opening station can be folded up; and a bottom-patch station, via which a bottom patch can be applied for closing the bag bottom, with at least one processing station on an operating side (BS) being disposed so as to be at least partly offset to a similar processing station on a drive side (AS), such that each of said processing stations carries out the same processing steps on one end of a tube piece.

2. The apparatus according to claim 1, wherein only the bottom-opening stations on the operating side (BS) and the drive side (AS) are disposed such that they are at least partly offset to each other.

3. The apparatus according to claim 1, wherein the valve patch station on the operating side (BS) is disposed opposite to the bottom-opening station on the drive side (AS).

4. The apparatus according to claim 1, wherein the processing stations on the operating side (BS) and the similar processing station on the drive side (AS) are disposed such that they are completely offset to each other.

5. The apparatus according to claim 4, wherein the offset has a zipper-like configuration.

6. The apparatus according to claim 1, wherein first the processing stations are disposed one after the other on the operating side (BS), and the similar processing stations are disposed in a completely offset manner relative thereto on the drive side (AS).

7. The apparatus according to claim 1, wherein first the processing stations are disposed one after the other on the drive side (AS), and the similar processing stations are disposed in a completely offset manner relative thereto on the operating side (BS).

8. The apparatus according to claim 1, wherein at least a first transport device, via which the tube pieces can be conveyed in the transport direction (x), is provided on the operating side (BS), and a second transport device is provided on the drive side (AS) such that the second transport device only partly overlaps the first transport device.

9. The apparatus according to claim 1, wherein at least a first transport device, via which the tube pieces can be conveyed in the transport direction (x), is provided on the operating side (BS), and a second transport device is provided on the drive side (AS) such that the second device does not overlap the first transport device.

10. A method for producing bags made of tube pieces having fabric made of stretched plastic strips and two material webs lying on top of each other, said method comprising:

with at least one transport device, conveying the tube pieces in a horizontal position in a transport direction (x) extending transversely to a direction of extension (z) of the tube pieces;

with at least one bottom-opening station, producing open bottom squares on at least one end of a tube piece;

with at least one valve patch station, applying a valve patch to the bottom square;

with at least one closing station, folding up the bottoms opened at the bottom-opening station; and with at least one bottom-patch station, applying a bottom patch for closing the bag bottom, with at least one processing station on an operating side (BS) being disposed so as to be at least partly offset to a similar processing station on a drive side (AS), such that each of said processing stations carries out the same processing steps on one end of a tube piece.

11. The method according to claim 10, wherein the tube piece is transported first on the operating side (BS) and then on the drive side (AS).

12. The method according to claim 10, wherein the tube piece is transported first on the drive side (AS) and then on the operating side (BS).

* * * * *